US008498557B2

(12) United States Patent
Nishiwaki

(10) Patent No.: US 8,498,557 B2
(45) Date of Patent: Jul. 30, 2013

(54) DEVELOPER SUPPLY DEVICE AND IMAGE FORMING APPARATUS HAVING THE SAME

(75) Inventor: Kenjiro Nishiwaki, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 267 days.

(21) Appl. No.: 13/015,649

(22) Filed: Jan. 28, 2011

(65) Prior Publication Data

US 2011/0188899 A1 Aug. 4, 2011

(30) Foreign Application Priority Data

Feb. 1, 2010 (JP) ..... 2010-020499

(51) Int. Cl.
*G03G 15/08* (2006.01)

(52) U.S. Cl.
USPC ..... 399/285; 399/289

(58) Field of Classification Search
USPC ..... 399/55, 281, 285, 289
See application file for complete search history.

(56) References Cited

U.S. PATENT DOCUMENTS 5,142,336 A * 8/1992 Hotomi et al. ..... 399/281
2009/0175662 A1 7/2009 Nishiwaki

FOREIGN PATENT DOCUMENTS

JP 2007-248963 9/2007
JP 2008-070803 3/2008

* cited by examiner

*Primary Examiner* — David Gray
*Assistant Examiner* — Erika J Villaluna
(74) *Attorney, Agent, or Firm* — Banner & Witcoff, Ltd.

(57) ABSTRACT

A developer supply device is provided, which includes a bias controller that, during an image forming operation by an image forming apparatus, applies a first bias to a first transfer board and applies a second bias to between a developer holding body and the first transfer board, so as to make the developer holding body hold development agent thereon while transferring the development agent along a first developer transfer path of the first transfer board. At least one of before and after the image forming operation, the bias controller applies the first bias to the first transfer electrodes without applying the second bias to between the developer holding body and the first transfer board, so as to transfer the development agent along the first developer transfer path without making the developer holding body hold the development agent.

4 Claims, 8 Drawing Sheets

DEVELOPER SUPPLY DEVICE AND IMAGE FORMING APPARATUS HAVING THE SAME

CROSS-REFERENCE TO RELATED APPLICATION

This application claims priority under 35 U.S.C. §119 from Japanese Patent Applications No. 2010-020499 filed on Feb. 1, 2010. The entire subject matter of the application is incorporated herein by reference.

BACKGROUND

1. Technical Field

The following description relates to one or more techniques for supplying development agent to an image forming unit of an image forming apparatus.

2. Related Art

An image forming apparatus has been known, which includes an electrostatic latent image holding body (a photoconductive drum), a developer holding body (a development roller), and an electric-field developer transfer unit.

The developer holding body is disposed to face the electrostatic latent image holding body in a predetermined development area. The developer holding body has a developer holding surface configured to hold and carry charged development agent.

The electric-field developer transfer unit is disposed upstream relative to the development area in a moving direction of the developer holding surface (i.e., in a rotational direction of the development roller) so as to face the developer holding surface across a predetermined distance. The electric-field developer transfer unit is provided with a plurality of transfer electrodes. Further, the electric-field developer transfer unit is configured to transfer the development agent with a traveling-wave electric field that is generated when a transfer bias (including a multi-phase alternating-current (AC) voltage) is applied to each of the plurality of transfer electrodes.

In this configuration, the development agent transferred by the traveling-wave electric field adheres onto the developer holding surface in a position where the electric-field transfer unit and the developer holding surface face each other. Thereby, the development agent is held and carried on the developer holding surface.

When the developer holding surface moves, the development agent held on the developer holding surface reaches the development area and is supplied to develop the electrostatic latent image. Thereby, the development agent adheres onto an electrostatic latent image holding surface, which is a circumferential surface of the electrostatic latent image holding body, so as to be arranged in a shape of an image corresponding to the electrostatic latent image. In other words, an image is formed with the development agent on the electrostatic latent image holding surface.

SUMMARY

In a device of this kind, when the development agent is held unevenly on the developer holding surface, the image might be formed with uneven density. Hence, to form the image with wholly even density in a favorable manner, it is critical to make the developer holding surface hold the development agent more evenly thereon.

Aspects of the present invention are advantageous to provide one or more improved techniques for supplying development agent to an electrostatic latent image holding body in an image forming apparatus, which techniques make it possible to make a developer holding surface hold and carry development agent evenly thereon.

According to aspects of the present invention, a developer supply device is provided, which is configured to supply charged development agent to an image forming unit of an image forming apparatus. The image forming unit is configured to perform an image forming operation of forming an image thereon by the supplied development agent. The developer supply device includes a developer holding body having a developer holding surface that is configured to hold the development agent thereon, formed as a cylindrical circumferential surface parallel to a first direction, and disposed to face the image forming unit in a first area where the development agent held on the developer holding surface is supplied to the image forming unit, the developer holding body being configured to rotate around an axis parallel to the first direction such that the developer holding surface moves in a second direction perpendicular to the first direction, a first transfer board including a plurality of first transfer electrodes arranged along a first developer transfer path perpendicular to the first direction, the first transfer board being configured to, when a first bias including a multi-phase alternating-current voltage is applied to the first transfer electrodes, generate a first traveling-wave electric field along the first developer transfer path and transfer the development agent along the first developer transfer path with the first traveling-wave electric field, the first transfer board being disposed to face the developer holding surface in a second area between an upstream end and a downstream end in a developer transfer direction on the first developer transfer path, a first bias applying unit configured to apply the first bias to the first transfer electrodes to transfer the development agent along the first developer transfer path, a second bias applying unit configured to apply a second bias to between the developer holding body and the first transfer board to transfer the development agent from the first transfer board onto the developer holding surface and make the developer holding surface hold the development agent, and a bias controller configured to, during the image forming operation performed by the image forming unit, control the first bias applying unit to apply the first bias to the first transfer electrodes and control the second bias applying unit to apply the second bias to between the developer holding body and the first transfer board, so as to make the developer holding surface hold the development agent while transferring the development agent along the first developer transfer path. The bias controller is configured to, at least one of before and after the image forming operation, control the first bias applying unit to apply the first bias to the first transfer electrodes and control the second bias applying unit not to apply the second bias to between the developer holding body and the first transfer board, so as to transfer the development agent along the first developer transfer path without making the developer holding surface hold the development agent.

According to aspects of the present invention, further provided is an image forming apparatus, which includes a developer supply device configured to supply charged development agent, and an image forming unit configured to perform an image forming operation of forming an image thereon by the supplied development agent. The developer supply device includes a developer holding body having a developer holding surface that is configured to hold the development agent thereon, formed as a cylindrical circumferential surface parallel to a first direction, and disposed to face the image forming unit in a first area where the development agent held on the developer holding surface is supplied to the image forming unit, the developer holding body being configured to rotate around an axis parallel to the first direction such that the developer holding surface moves in a second direction perpendicular to the first direction, a first transfer board including a plurality of first transfer electrodes arranged along a first developer transfer path perpendicular to the first direction, the first transfer board being configured to, when a first bias including a multi-phase alternating-current voltage is applied to the first transfer electrodes, generate a first traveling-wave electric field along the first developer transfer path and transfer the development agent along the first developer transfer path with the first traveling-wave electric field, the first transfer board being disposed to face the developer holding surface in a second area between an upstream end and a downstream end in a developer transfer direction on the first developer transfer path, a first bias applying unit configured to apply the first bias to the first transfer electrodes to transfer the development agent along the first developer transfer path, a second bias applying unit configured to apply a second bias to between the developer holding body and the first transfer board to transfer the development agent from the first transfer board onto the developer holding surface and make the developer holding surface hold the development agent, and a bias controller configured to, during the image forming operation performed by the image forming unit, control the first bias applying unit to apply the first bias to the first transfer electrodes and control the second bias applying unit to apply the second bias to between the developer holding body and the first transfer board, so as to make the developer holding surface hold the development agent while transferring the development agent along the first developer transfer path. The bias controller is configured to, at least one of before and after the image forming operation, control the first bias applying unit to apply the first bias to the first transfer electrodes and control the second bias applying unit not to apply the second bias to between the developer holding body and the first transfer board, so as to transfer the development agent along the first developer transfer path without making the developer holding surface hold the development agent.

BRIEF DESCRIPTION OF THE ACCOMPANYING DRAWINGS

Figure 4:
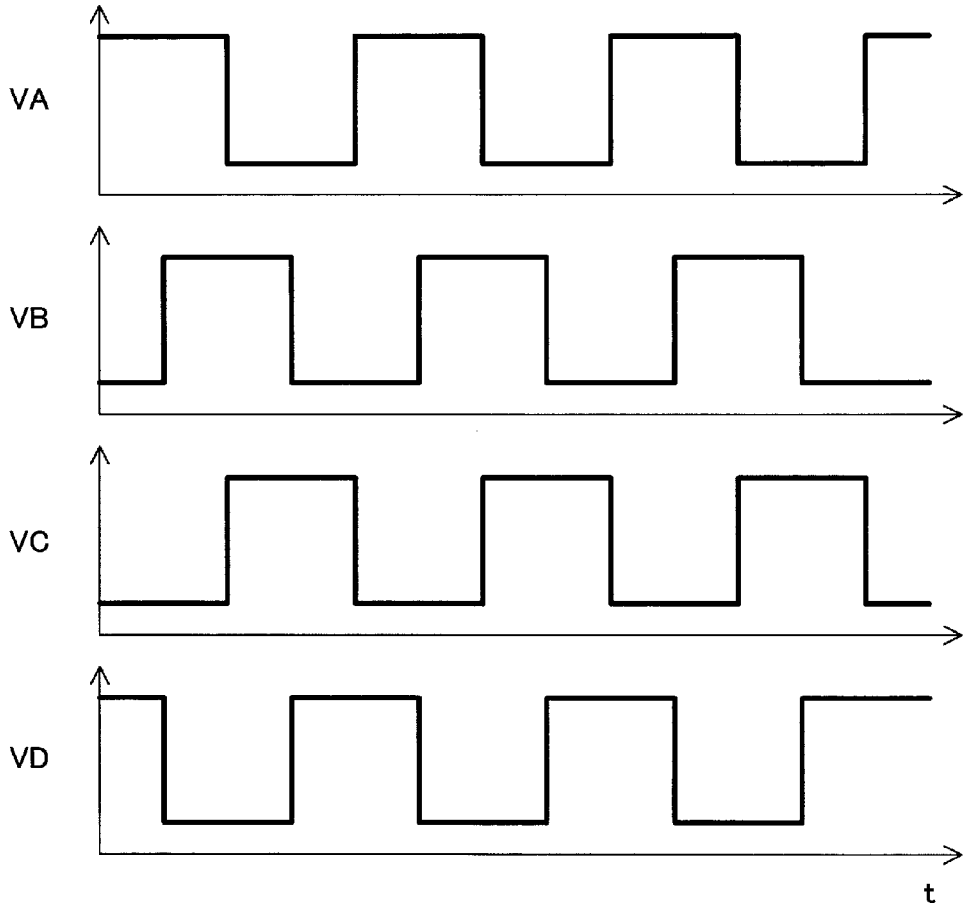

FIG. 4 exemplifies waveforms of voltages generated by power supply circuits for the electric-field transfer board in the embodiment according to one or more aspects of the present invention.

Figure 5A:
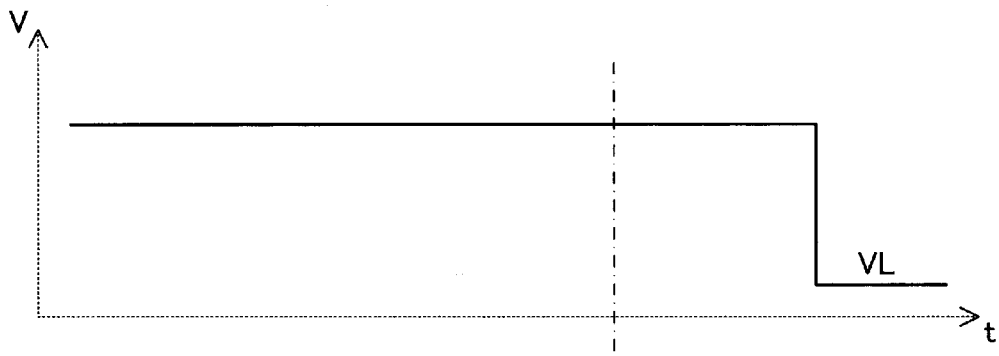
Figure 6A:
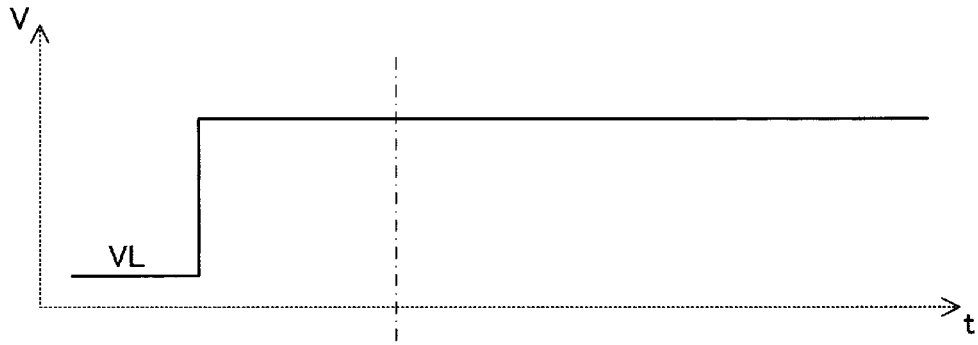

FIGS. 5A and 6A are time charts showing time variation of a surface potential of an electrostatic latent image holding surface in the embodiment according to one or more aspects of the present invention.

Figure 5B:
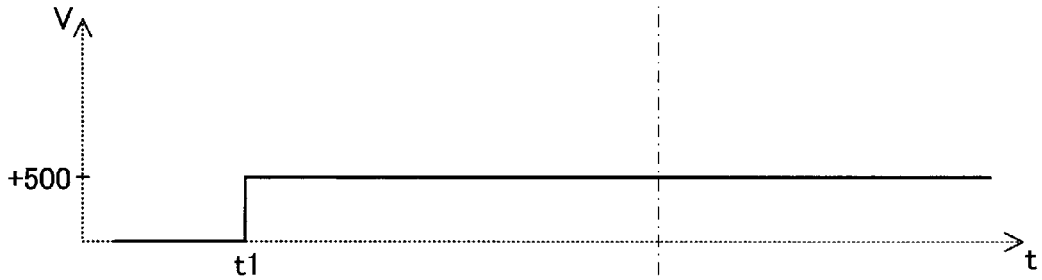
Figure 6B:
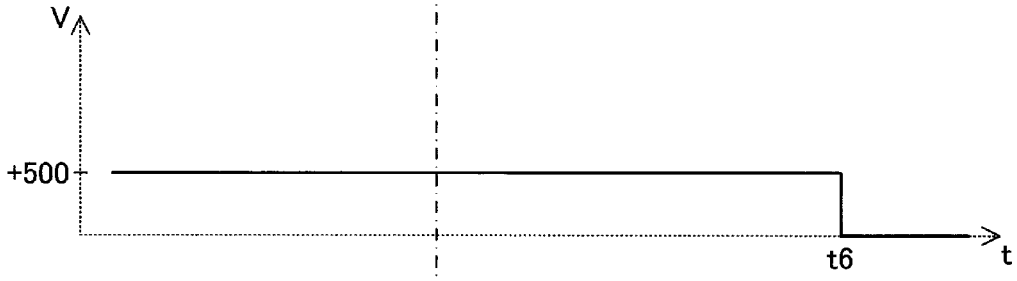

FIGS. 5B and 6B are time charts showing time variation of an output voltage from a development-bias power supply circuit in the embodiment according to one or more aspects of the present invention.

Figure 5C:
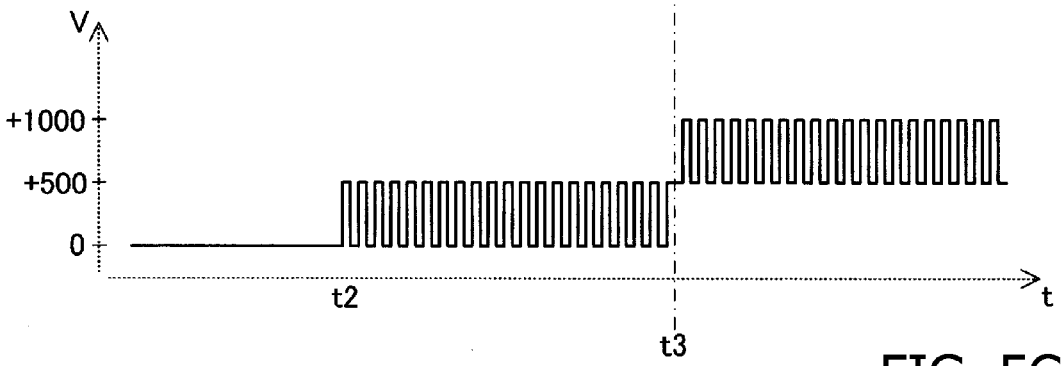
Figure 6C:
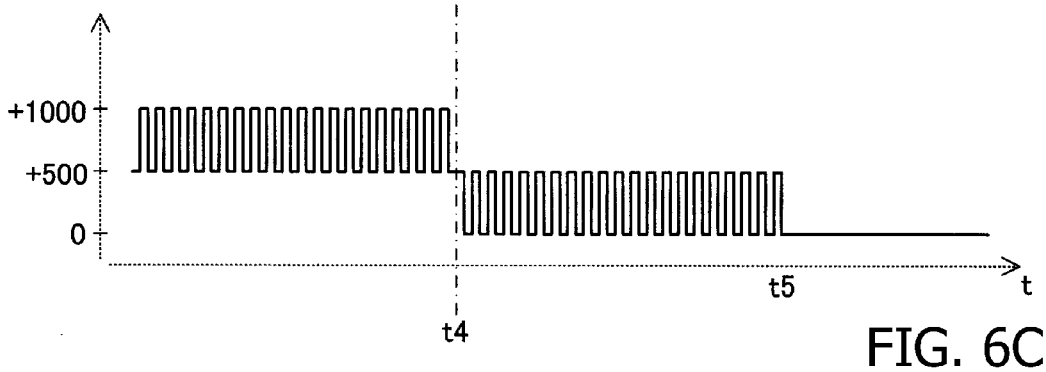

FIGS. 5C and 6C are time charts showing time variation of an output voltage from a supply-bias power supply circuit in the embodiment according to one or more aspects of the present invention.

Figure 7A:
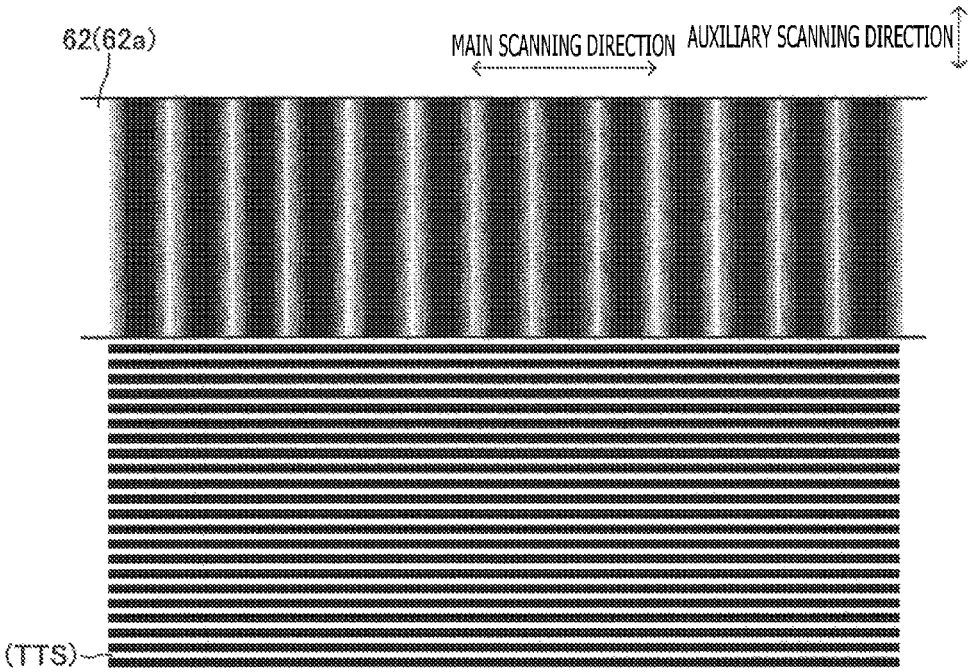
Figure 7B:
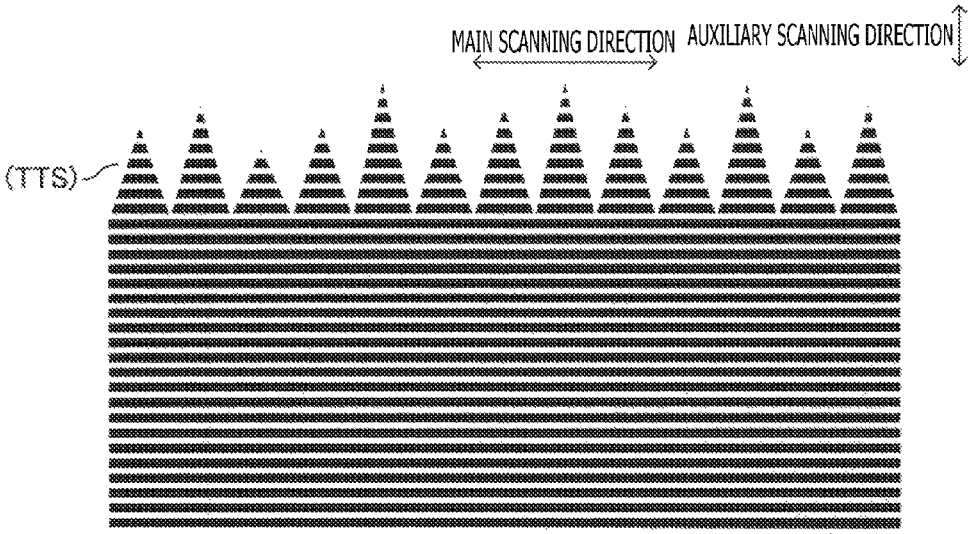

FIGS. 7A and 7B show an undesired situation where toner is unevenly held on a toner holding surface of a development roller and a toner transfer surface of a first electric-field transfer board in a comparative example.

Figure 8A:
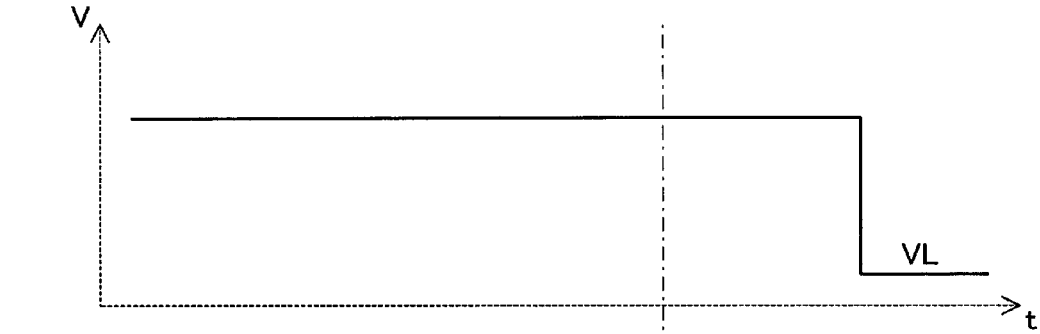

FIG. 8A is a time chart showing time variation of the surface potential of the electrostatic latent image holding surface in a modification according to one or more aspects of the present invention.

Figure 8B:
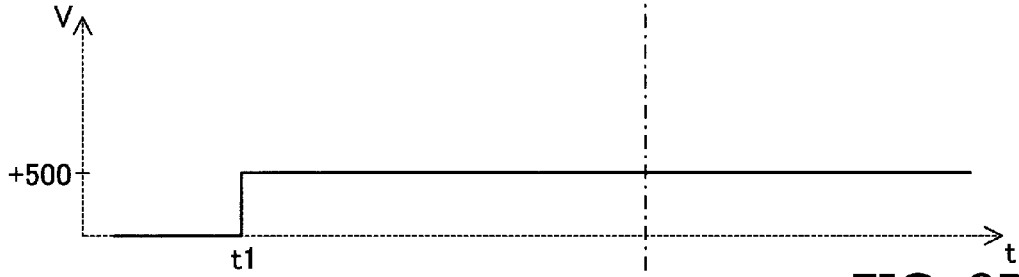

FIG. 8B is a time chart showing time variation of the output voltage from the development-bias power supply circuit in the modification according to one or more aspects of the present invention.

Figure 8C:
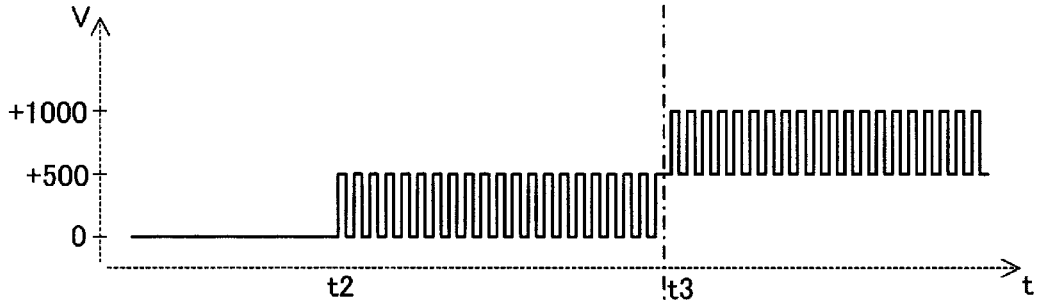

FIG. 8C is a time chart showing time variation of the output voltage from the supply-bias power supply circuit in the modification according to one or more aspects of the present invention.

Figure 8D:
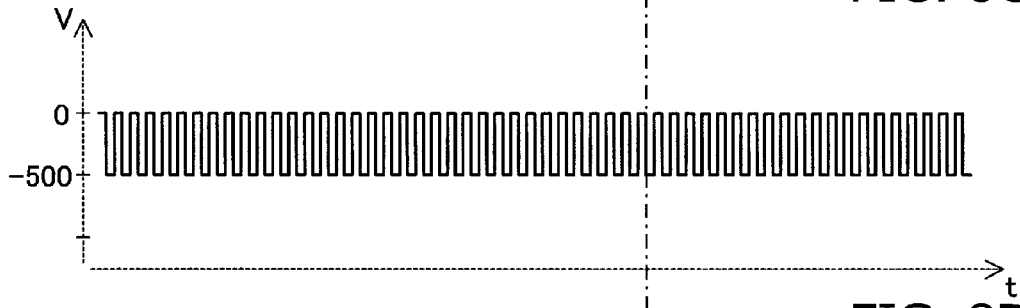

FIG. 8D is a time chart showing time variation of an output voltage from a retrieving-bias power supply circuit in the modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

Figure 1:
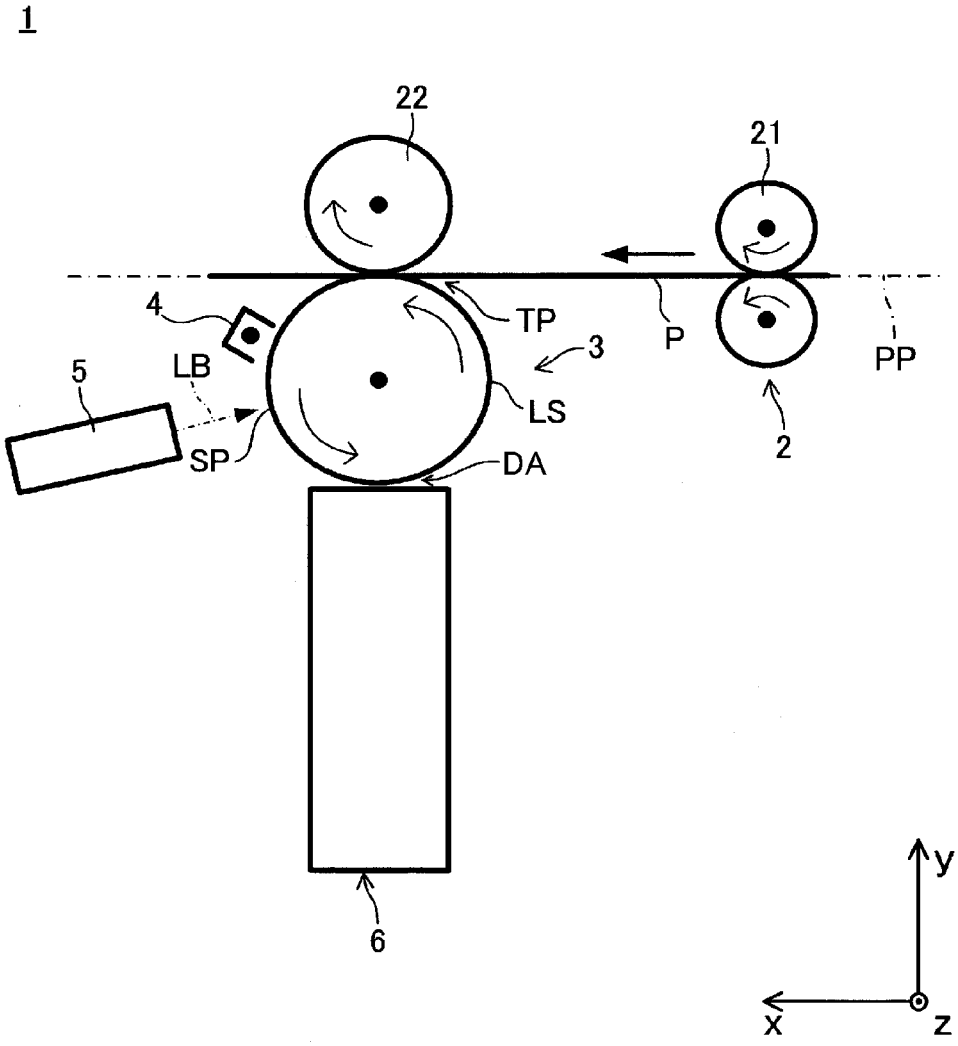
FIG. 1 is a cross-sectional side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6. The laser printer 1 further includes therein a feed tray (not shown) configured such that a stack of sheets P is placed thereon. The sheet feeding mechanism 2 is configured to feed a sheet P along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1). The electrostatic latent image holding surface LS is configured such that an electrostatic latent image is formed thereon in accordance with an electric potential distribution. Further, the electrostatic latent image holding surface LS is configured to hold toner T (see FIG. 2) in positions corresponding to the electrostatic latent image. The photoconductive drum 3 is driven to rotate in a counterclockwise direction indicated by arrows in FIG. 1 around an axis that is parallel to the main scanning direction. Thus, the photoconductive drum 3 is configured to move the electrostatic latent image holding surface LS along an auxiliary scanning direction perpendicular to the main scanning direction.

The electrification device 4 is disposed to face the electrostatic latent image holding surface LS. The electrification device 4, which is of a corotron type or a scorotron type, is configured to evenly and positively charge the electrostatic latent image holding surface LS.

The scanning unit 5 is configured to generate a laser beam LB modulated based on image data. Specifically, the scanning unit 5 is configured to generate the laser beam LB within a predetermined wavelength range, which laser beam LB is emitted under ON/OFF control depending on whether there is a pixel in a target location on the image data. In addition, the scanning unit 5 is configured to converge the laser beam LB in a scanned position SP on the electrostatic latent image holding surface LS and move (scan) the convergence point of the laser beam LB along the main scanning direction at a constant speed. Here, the scanned position SP is set in a position downstream relative to the electrification device 4 in the rotational direction of the photoconductive drum 3 (i.e., the counterclockwise direction indicated by the arrows in FIG. 1).

The toner supply device 6 is disposed under the photoconductive body 3 so as to face the electrostatic latent image holding surface LS in a development area DA downstream relative to the scanned position SP in the rotational direction of the photoconductive drum 3. The toner supply device 6 is configured to supply the charged toner T (see FIG. 2), in the development area DA, onto (the electrostatic latent image holding surface LS of) the photoconductive drum 3. It is noted that the development area DA denotes an area where the toner supply device 6 faces the electrostatic latent image holding surface LS. A detailed explanation will be provided later about the configuration of the toner supply device 6.

Subsequently, a detailed explanation will be provided about a specific configuration of each element included in the laser printer 1.

The sheet feeding mechanism 2 includes a pair of registration rollers 21, and a transfer roller 22. The registration rollers 21 are configured to feed a sheet P toward between the photoconductive drum 3 and the transfer roller 22 at a predetermined moment. The transfer roller 22 is disposed to face the electrostatic latent image holding surface LS across the sheet feeding path PP in a transfer position TP. Additionally, the transfer roller 22 is driven to rotate in a clockwise direction indicated by an arrow in FIG. 1. The transfer roller 22 is connected to a bias power supply circuit (not shown). Specifically, the transfer roller 22 is configured such that a predetermined transfer bias voltage is applied to between the transfer roller 22 and the photoconductive drum 3 so as to transfer, onto the sheet P, the toner T (see FIG. 2) which adheres onto the electrostatic latent image holding surface LS.

<<Toner Supply Device>>

Figure 2:
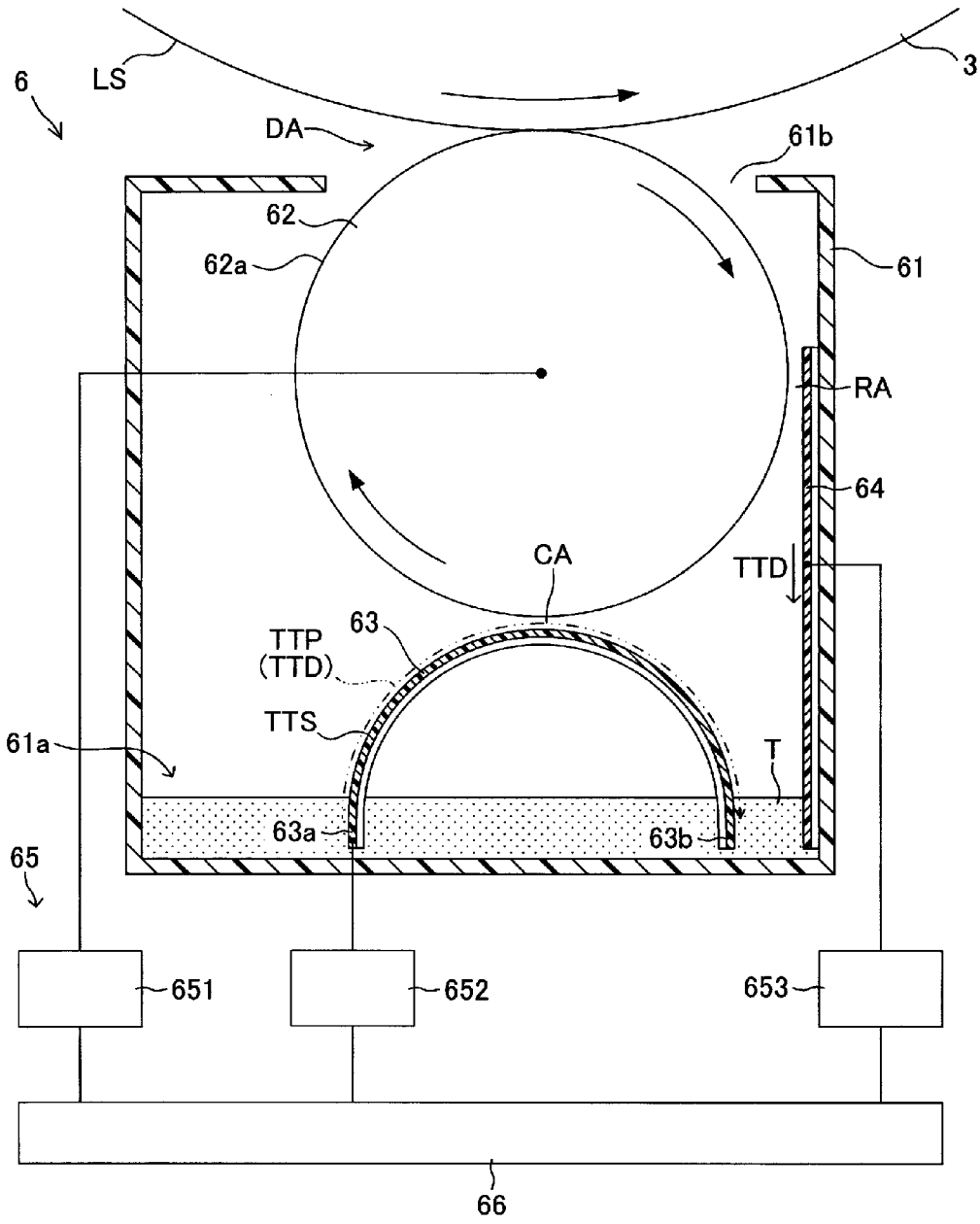
FIG. 2 is an enlarged cross-sectional side view of a toner supply device for the laser printer in the embodiment according to one or more aspects of the present invention.

As depicted in FIG. 2 that is a cross-sectional side view (a cross-sectional view along a plane with the main scanning direction as a normal line) of the toner supply device 6, a toner box 61, which forms a casing of the toner supply device 6, is a box-shaped member. The toner box 61 includes a toner storage section 61*a*, which is a bottom section of an inner space of the toner box 61 and configured to accommodate the toner T (powdered dry-type development agent). It is noted that in the embodiment, the toner T is positively-chargeable nonmagnetic-one-component black toner. Further, the toner box 61 has an opening 61*b* formed in such a position at a top of the toner box 61 as to face the photoconductive drum 3. In other words, the opening 61*b* is opened up toward the photoconductive drum 3.

The development roller 62 is a roller-shaped member having a toner holding surface 62*a* that is a cylindrical circumferential surface parallel to the main scanning direction. The development roller 62 is housed in the toner box 61 such that the toner holding surface 62*a* is exposed to the outside of the toner box 61 via the opening 61*b*.

The development roller 62 is disposed to face the development area DA. Specifically, the development roller 62 is disposed such that a top of the toner holding surface 62*a* thereof is opposite and in closest proximity to the electrostatic latent image holding surface LS of the photoconductive drum 3 in the development area DA across a predetermined gap.

The development roller 62 is supported in a position near the opening 61*b* of the toner box 61 to be rotatable around an axis parallel to the main scanning direction. Specifically, the development roller 62 is configured to supply the toner T held on the toner holding surface 62*a* to the development area DA, when the toner holding surface 62*a* moves in a direction perpendicular to the main scanning direction in response to the development roller 62 rotating around the axis parallel to the main scanning direction, in a clockwise direction indicated by arrows in FIG. 2.

Inside the toner box 61, a first electric-field transfer board 63 for supplying the toner T is provided under the development roller 62. The first electric-field transfer board 63 is formed in a shape of a half cylinder that is convex upward when viewed in the main scanning direction. The first electric-field transfer board 63 has a toner transfer surface TTS that is an (upper) outer surface of the first electric-field transfer board 63.

The transfer board 63 is configured to transfer the toner T with a traveling-wave electric field, on a toner transfer surface TTS in a toner transfer direction TTD along a toner transfer path TTP. The toner transfer path TTP is a path on which the toner T is transferred along the toner transfer surface TTS by the traveling-wave electric field, and formed in a shape of a half circle that is convex upward when viewed in the main scanning direction. The toner transfer path TTP is perpendicular to the main scanning direction. Further, the toner transfer direction TTD is a tangential direction that is defined in a given point on the toner transfer path TTP when viewed in the main scanning direction.

The first electric-field transfer board 63 has an upstream end 63*a* and a downstream end 63*b* in the toner transfer direction TTD that are disposed in the toner storage section 61*a* to be immersed in the toner T stored in the toner box 61. The first electric-field transfer board 63 is disposed such that a top of the toner transfer surface TTS, which is an intermediate portion of the first electric-field transfer board 63 between the upstream end 63*a* and the downstream end 63*b* in the toner transfer direction TTD, is opposite and in closest proximity to a lower end of the toner holding surface 62*a* of the development roller 62 in a carrying area CA. The carrying area CA is a top area of the toner transfer path TTP provided in an intermediate position between an upstream end and a downstream end of the toner transfer path TTP in the toner transfer direction TTD.

The first electric-field transfer board 63 is configured to supply the toner T to the toner holding surface 62*a* in the carrying area CA and convey, back to the toner storage section 61*a*, the toner T left without being transferred to the toner holding surface 62*a* in the carrying area CA, while transferring the toner T from the upstream end 63*a* toward the downstream end 63*b*. In the embodiment, the first electric-field transfer board 63 is configured such that the toner transfer direction TTD (a rightward direction indicated by a chain double-dashed line in FIG. 2) is a direction opposite to a moving direction (a leftward direction in FIG. 2) of the toner holding surface 62*a* in the carrying area CA. It is noted that a detailed internal configuration of the first electric-field transfer board 63 will be described later.

Inside the toner box 61, there is a second electric-field transfer board 64 for retrieving the toner T that is substantially plane-shaped and disposed lateral to the development roller 62. A downstream end of the second electric-field transfer board 64 in the toner transfer direction TTD is disposed in the toner storage section 61*a* so as to be immersed in the toner T stored in the toner box 61. An upstream end of the second electric-field transfer board 64 in the toner transfer direction TTD is disposed to face the toner holding surface 62*a* in a retrieving area RA that is located downstream relative to the development area DA and upstream relative to the carrying area CA in the moving direction of the toner holding surface 62*a*.

The second electric-field transfer board 64 is configured to retrieve (remove) the toner T, which remains on the toner holding surface 62*a* without being transferred to the electrostatic latent image holding surface LS in the development area DA, from the toner holding surface 62*a* in the retrieving area RA, and convey the retrieved toner T back to the toner storage section 61*a*. It is noted that a detailed internal configuration of the second electric-field transfer board 64 will be described later.

The development roller 62, the first electric-field transfer board 63, and the second electric-field transfer board 64 are electrically connected with a bias supply unit 65. The bias supply unit 65 is electrically connected with a bias controller 66. The bias controller 66 is a microcomputer configured to control an operation of each element (including the bias supply unit 65) included in the laser printer 1. The bias controller 66 has a CPU, a ROM, a RAM, and a backup RAM (EEPROM). It is noted that detailed explanation about the bias supply unit 65 and the bias controller 66 will be provided later.

<<<Transfer Board>>>

Figure 3:
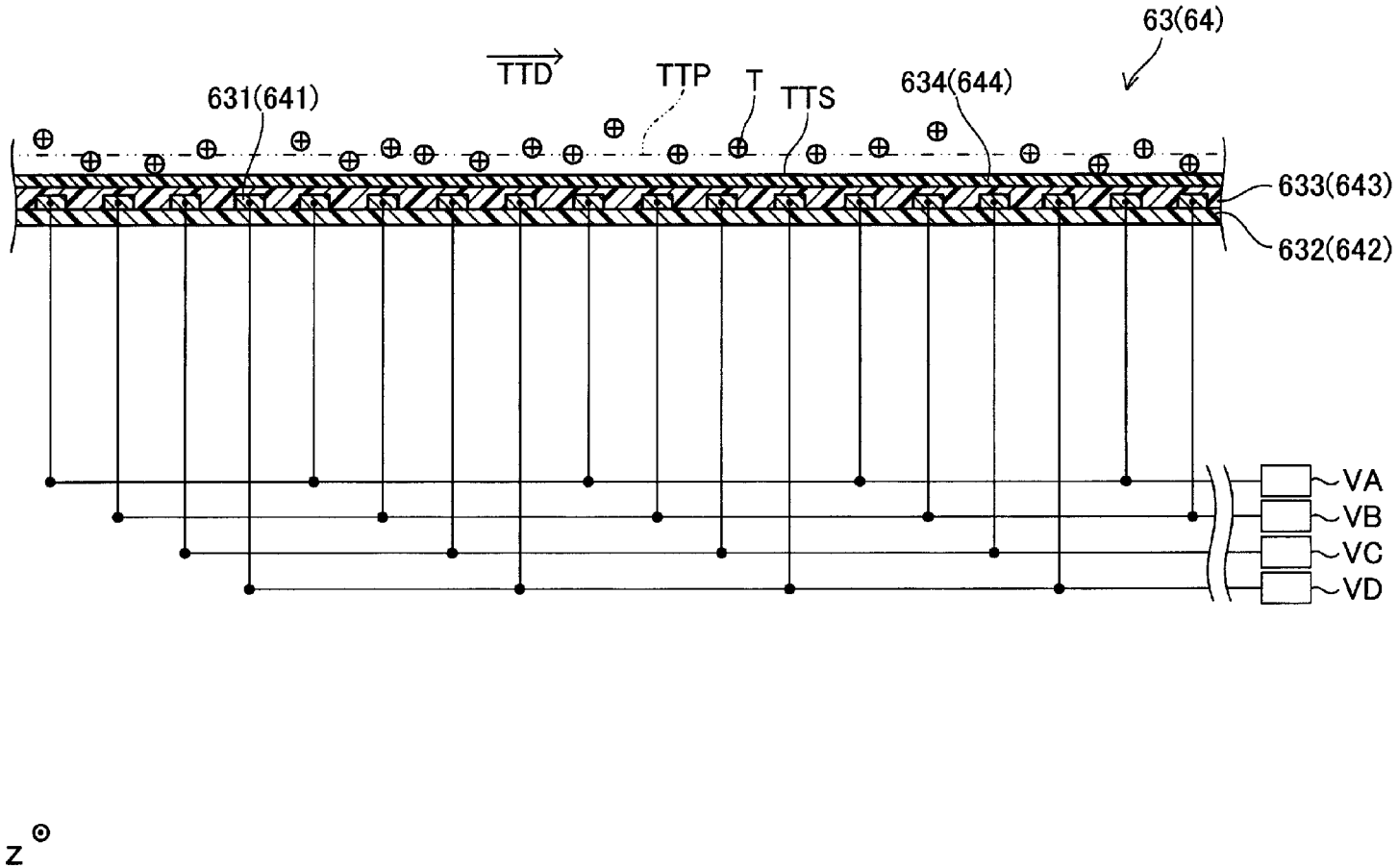
FIG. 3 is an enlarged cross-sectional side view of an electric-field transfer board for the toner supply device in the embodiment according to one or more aspects of the present invention.

Referring to FIG. 3, the first electric-field transfer board 63 and the second electric-field transfer board 64 are thin plate members configured in the same manner as a flexible printed-circuit board.

Specifically, the first electric-field transfer board 63 includes a plurality of first transfer electrodes 631, a supporting film layer 632, an electrode coating layer 633, and an overcoating layer 634. The second electric-field transfer board 64 includes a plurality of second transfer electrodes 641, a supporting film layer 642, an electrode coating layer 643, and an overcoating layer 644. The second electric-field transfer board 64 is configured substantially in the same manner as the first electric-field transfer board 63. Hereinafter, an internal configuration of the first electric-field transfer board 63 will be described. It is noted that the following explanation about the internal configuration of the first electric-field transfer board 64 may be referred to as required for explanation about the internal configuration of the second electric-field transfer board 64.

The first transfer electrodes 631 are linear wiring patterns elongated in a direction parallel to the main scanning direction (i.e., perpendicular to the auxiliary scanning direction). The first transfer electrodes 631 are formed with copper thin films. The first transfer electrodes 631 are arranged along the toner transfer path TTP so as to be parallel to each other.

Every fourth one of the first transfer electrodes 631, arranged along the toner transfer path TTP, is connected with a specific one of four power supply circuits VA, VB, VC, and VD. In other words, the first transfer electrodes 631 are arranged along the toner transfer path TTP in the following order: a first transfer electrode 631 connected with the power supply circuit VA, a first transfer electrode 631 connected with the power supply circuit VB, a first transfer electrode 631 connected with the power supply circuit VC, a first transfer electrode 631 connected with the power supply circuit VD, a first transfer electrode 631 connected with the power supply circuit VA, a first transfer electrode 631 connected with the power supply circuit VB, a first transfer electrode 631 connected with the power supply circuit VC, a first transfer electrode 631 connected with the power supply circuit VD, . . . (it is noted that the power supply circuits VA, VB, VC, and VD are included in a supply-bias power supply circuit 652 or a retrieving-bias power supply circuit 653 shown in FIG. 2).

FIG. 4 exemplifies output waveforms, which are generated respectively by the power supply circuits VA, VB, VC, and VD shown in FIG. 3. In the embodiment, as illustrated in FIG. 4, the power supply circuits VA, VB, VC, and VD are configured to generate respective AC driving voltages having substantially the same waveform. Further, the power supply circuits VA, VB, VC, and VD are configured to generate the respective AC driving voltages with a phase difference of 90 degrees between any adjacent two of the power supply circuits VA, VB, VC, and VD in the aforementioned order. In other words, the power supply circuits VA, VB, VC, and VD are configured to output the respective AC driving voltages each of which is delayed by a phase of 90 degrees behind the voltage output from a precedent adjacent one of the power supply circuits VA, VB, VC, and VD in the aforementioned order. Thus, the first transfer board 63 is configured to transfer the positively charged toner T in the toner transfer direction TTD when the aforementioned diving voltages are applied to the first transfer electrodes 631 such that the traveling-wave electric field is generated along the toner transfer path TTP.

The first transfer electrodes 631 are formed on a surface of the supporting film layer 632. The supporting film layer 632 is a flexible film made of electrically insulated synthetic resin such as polyimide resin. The electrode coating layer 633 is made of electrically insulated synthetic resin. The electrode coating layer 633 is provided to coat the first transfer electrodes 631 and the surface of the supporting film layer 632 on which the first transfer electrodes 631 are formed. On the electrode coating layer 633, the overcoating layer 634 is provided. The surface of the overcoating layer 634 is formed as a smooth surface with a very low level of irregularity, so as to smoothly convey the toner T.

<<<Bias Supply Unit>>>

Referring back to FIG. 2, the bias supply unit 65 includes a development-bias power supply circuit 651, the supply-bias power supply circuit 652, and the retrieving-bias power supply circuit 653.

FIGS. 5A to 5C and 6A to 6C are time charts for explaining operations of the laser printer 1 shown in FIG. 1, which time charts show output voltages from the development-bias power supply circuit 651, the supply-bias power supply circuit 652, and the retrieving-bias power supply circuit 653 that are shown in FIG. 2. FIGS. 5A and 6A show time variation of a surface potential of the electrostatic latent image holding surface LS (the "VL" indicates a potential of an exposed area). FIGS. 5B and 6B show time variation of an output voltage from the development-bias power supply circuit 651. FIGS. 5C and 6C show time variation of an output voltage from the supply-bias power supply circuit 652.

The development-bias power supply circuit 651 is electrically connected with the development roller 62. As depicted in FIGS. 5B and 6B, the development-bias power supply circuit 651 is configured to output a DC voltage of +500 V so as to apply a development bias of 500 V to the development roller 62 (more specifically, to between the exposed area with the electrical potential "VL" on the electrostatic latent image holding surface LS and the development roller 62).

The supply-bias power supply circuit 652 is electrically connected with the first electric-field transfer board 63. As depicted in FIGS. 4, 5C, and 6C, the supply-bias power supply circuit 652 is configured to output multi-phase AC voltages of 0 V to +500 V or +500 V to +1000 V.

Namely, the supply-bias power supply circuit 652 is configured to apply transfer biases (including multi-phase AC voltages) with an amplitude of 250V to the first electric-field transfer board 63 (more specifically, to between any adjacent two of the first transfer electrodes 631), so as to transfer the toner T along the toner transfer path TTP. Further, the supply-bias power supply circuit 652 is configured to output multi-phase AC voltages of +500 V to +1000 V when the development-bias power supply circuit 651 outputs a DC voltage of +500 V. Thereby, a holding bias of 500 V is applied to between the development roller 62 and the first electric-field transfer board 63, so as to make the positively charged toner T transfer from the first electric-field transfer board 63 to the toner holding surface 62*a* and held on the toner holding surface 62*a* at a time when a peak voltage of +1000 V is generated.

The retrieving-bias power supply circuit 653 is electrically connected with the second electric-field transfer board 64. The retrieving-bias power supply circuit 653 is configured to output multi-phase AC voltages of −500 V to 0 V. Namely, the retrieving-bias power supply circuit 653 is configured to apply a retrieving bias to make the positively charged toner T transfer from the toner holding surface 62*a* to the second electric-field transfer board 64 and retrieved in the retrieving area RA, and further conveyed from the retrieving area RA toward the toner storage section 61*a*.

The bias controller 66 is configured to control operations (voltage outputting states) of the development-bias power supply circuit 651, the supply-bias power supply circuit 652, and the retrieving-bias power supply circuit 653. Specifically, the bias controller 66 is configured to control the supply-bias power supply circuit 652 to achieve the following operations: (1) to make the toner holding surface 62*a* hold the toner T while transferring the toner T along the toner transfer path TTP with the transfer bias and the holding bias applied in developing the electrostatic latent image in the development area DA (in an image forming operation); and (2) to transfer the toner T along the toner transfer path TTP while preventing the toner holding surface 62*a* from holding the toner T with the transfer bias applied and the holding bias not applied just before and after the aforementioned image forming operation.

<Operations of Laser Printer>

Subsequently, operations of the laser printer 1 configured as above will be outlined with reference to the relevant drawings.

<<Sheet Feeding>>

Referring to FIG. 1, initially, a leading end of the sheet P placed on the feed tray (not shown) is fed to the registration rollers 21. The registration rollers 21 perform skew correction for the sheet P, and adjust timing for feeding the sheet P forward. Thereafter, the sheet P is fed to the transfer position TP.

<<Formation of Toner Image on Electrostatic Latent Image Holding Surface>>

While the sheet P is being conveyed to the transfer position TP as described above, a toner image (i.e., an image formed with the toner T arranged in a desired image shape) is held on the electrostatic latent image holding surface LS that is the outer circumferential surface of the photoconductive drum 3, as will be mentioned below.

<<Formation of Electrostatic Latent Image>>

Firstly, the electrostatic latent image holding surface LS of the photoconductive drum 3 is charged evenly and positively by the electrification device 4. The electrostatic latent image holding surface LS, charged by the electrification device 4, is moved along the auxiliary scanning direction to the scanned position SP to face the scanning unit 5, when the photoconductive drum 3 rotates in the counterclockwise direction indicated by the arrows in FIG. 1.

In the scanned position SP, the electrostatic latent image holding surface LS is exposed to the laser beam LB that is modulated based on the image data. Namely, while being scanned along the main scanning direction, the laser beam LB is rendered incident onto the electrostatic latent image holding surface LS. In accordance with the modulation of the laser beam LB, areas with no positive charge remaining thereon are generated on the electrostatic latent image holding surface LS. Thereby, an electrostatic latent image is formed with a positive charge pattern (positive charges distributed in the desired image shape) on the electrostatic latent image holding surface LS. The electrostatic latent image, formed on the electrostatic latent image holding surface LS, moves to the development area DA opposite the toner supply device 6, when the photoconductive drum 3 rotates in the counterclockwise direction indicated by the arrows in FIG. 1.

<<Transfer and Supply of Charged Toner>>

Referring to FIGS. 2 and 3, the toner T stored in the toner box 61 is charged due to contact or friction with the overcoating layer 634 at the upstream end 63*a* of the first transfer board 63. The charged toner T is conveyed from the upstream end 63*a* toward the carrying area CA in the toner transfer direction TTD, by the traveling-wave electric field generated when the aforementioned transfer bias voltage is applied to the first transfer electrodes 631 of the first electric-field transfer board 63.

The toner T, which is being conveyed in the toner transfer direction TTD by the first electric-field transfer board 63, is transferred onto and held on the toner holding surface 62*a* when reaching the carrying area CA. The toner T, which has not been transferred onto the toner holding surface 62*a*, is conveyed from the carrying area CA toward the downstream end 63*b*, and then back into the toner storage section 61*a*.

The toner holding surface 62*a*, which holds thereon the positively charged toner T in the carrying area CA, is driven to rotate in the clockwise direction indicated by the arrows in FIG. 2 and move to the development area DA. Thereby, the toner T is supplied to the development area DA. In the development area DA, the electrostatic latent image formed on the electrostatic latent image holding surface LS is developed with the toner T. Namely, the toner T adheres to an area with no positive charge on the electrostatic latent image holding surface LS. Thereby, the toner image is held on the electrostatic latent image holding surface LS.

There is a "record (residual toner) after development" left on the toner holding surface 62*a* which has passed through the development area DA. Specifically, on the toner holding surface 62*a*, the toner T, which has not been transferred onto the electrostatic latent image holding surface LS in the development area DA, remains in a shape of a negative image that is a reversed image of the toner image formed on the electrostatic latent image holding surface LS. The remaining toner T moves to the retrieving area RA when the development roller 62 is driven to rotate in the clockwise direction indicated by the arrows in FIG. 2. In the retrieving area RA, the toner T remaining on the toner holding surface 62*a* is retrieved by the second electric-field transfer board 64. The toner T, retrieved by the second electric-field transfer board 64, is conveyed back into the toner storage section 61*a* by the traveling-wave electric field that is generated when the retrieving bias is applied.

After the remaining toner T is retrieved (removed) in the retrieving area RA in a favorable manner and the "record after development" is eliminated, the development roller is driven to rotate in the clockwise direction indicated by the arrows in FIG. 2 such that the toner holding surface 62*a* reaches the carrying area CA again to hold and carry new toner T. Thus, it is possible to prevent the toner T from being held again on the toner holding surface 62*a* with the "record after development" left thereon and prevent a ghost from appearing in a subsequently formed image, in a favorable manner.

<<Transfer of Toner Image from Electrostatic Latent Image Holding Surface onto Sheet>>

Referring to FIG. 1, the toner image, which is held on the electrostatic latent image holding surface LS of the photoconductive drum 3 as described above, is conveyed to the transfer position TP when the electrostatic latent image holding surface LS turns in the counterclockwise direction indicated by the arrows in FIG. 1. Then, in the transfer position TP, the toner image is transferred from the electrostatic latent image holding surface LS onto the sheet P. After that, the toner image is fixed onto the sheet P by a fixing unit (not shown). Thereby, an image is formed with the toner T on the sheet P.

EFFECTS

Effects provided in the embodiment will be described in detail with reference to the relevant drawings.

Referring to FIGS. 5A to 5C, initially, at a time t1, the development-bias power supply circuit 651 starts outputting a DC voltage of +500 V (see FIG. 5B). After that, during a period of times t2 to t3, the supply-bias power supply circuit 652 outputs multi-phase AC voltages of 0 V to +500 V (see FIG. 5C). Therefore, during the period of the times t2 to t3 just before the image forming operation, the transfer bias is applied while the holding bias is not applied. Thus, during the period of the times t2 to t3, the toner T is transferred along the toner transfer path TTP while the toner T is not held or carried on the toner holding surface 62*a* (hereinafter, such a toner transferring state will be referred to as "through-transfer.") Thereafter, at the time t3, the output voltages from the supply-bias power supply circuit 652 are switched to multi-phase AC voltages of +500 V to +1000 V (see FIG. 5C). Therefore, at and after the time t3, the transfer bias and the holding bias are applied such that the toner T is transferred along the toner transfer path TTP while the toner T is held and carried on the toner holding surface 62*a*. Thus, at and after the time t3, the electrostatic latent image is formed and developed on the electrostatic latent image holding surface LS (see FIGS. 5A and 5C).

Referring to FIGS. 6A to 6C, when the electrostatic latent image has completely been formed and developed on the electrostatic latent image holding surface LS (see FIG. 6A), initially, at a time t4, the output voltages from the supply-bias power supply circuit 652 are switched from the multi-phase AC voltages of +500 V to +1000 V to multi-phase AC voltages of 0 V to +500 V (see FIG. 6C). Therefore, during a period of the times t4 to t5 immediately after the image forming operation, the transfer bias is applied while the holding bias is not applied. Thus, at and after the time t4, the toner holding surface 62*a* stops holding the toner T thereon. Hence, during the period of the times t4 to t5 as well, the aforementioned "through-transfer" is carried out.

After the supply-bias power supply circuit 652 stops outputting the voltage at the time t5 (see FIG. 6C), the development-bias power supply circuit 651 stops outputting the voltage (see FIG. 6B).

During the period of the times t2 to t3 (see FIG. 5C) and the period of the times t4 to t5 (see FIG. 6C), when the supply-bias power supply circuit 652 outputs multi-phase AC voltages of +500 V to +1000 V in the same manner as implemented in the image forming operation (during the period of the times t3 to t4), vertical stripes along the auxiliary scanning direction are generated in the formed image. The vertical stripes are generated due to uneven density of the formed image in the main scanning direction.

At this time, inspection of the broken-down laser printer 1 provides the following information. As illustrated in FIG. 7A, a pattern of the toner T unevenly held that corresponds to the aforementioned vertical stripes is generated on the toner holding surface 62*a* of the development roller 62. The pattern is generated due to unevenness of the amount of the toner T held on the toner holding surface 62*a* in the main scanning direction. Further, a horizontal stripe pattern, shown below the development roller 62 in FIG. 7A, is a pattern of the toner T that remains on the toner transfer surface TTS so as to correspond to the first transfer electrodes 631.

Further, observation of an area corresponding to the carrying area CA on the toner transfer surface TTS which is separated from the development roller 62 provides the following information. As shown in FIG. 7B, a pattern of the toner T adhering (remaining), which corresponds to the pattern of the toner T unevenly held on the toner holding surface 62*a* in the main scanning direction, is generated on the toner transfer surface TTS (see a jagged upper portion in FIG. 7B). The pattern of the toner T adhering is regarded as a "record of toner transferring" that may be generated on the toner transfer surface TTS for some reasons (e.g., the toner transfer surface TTS having contaminations locally adhering thereto or locally charged up) when the toner T is transferred onto the toner holding surface 62*a* in the carrying area CA while being conveyed on the toner transfer surface TTS.

On the contrary, in the embodiment, during the periods of the times t2 to t3 (see FIGS. 5A to 5C) and the times t4 to t5 (see FIGS. 6A to 6C), the aforementioned "through-transfer" is performed. Therefore, in the embodiment, it is possible to effectively avoid the undesired situation as shown in FIGS. 7A and 7B. Thus, in the embodiment, it is possible to effectively prevent the toner T from being held unevenly on the toner holding surface 62*a*. Hence, according to aspects of the present invention, it is possible to make the toner holding surface 62*a* hold the toner T more evenly, and to perform an image forming operation in a more favorable manner.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

Aspects of the present invention may be applied to electrophotographic image forming devices such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in a shape of a plate or an endless belt. Additionally, light sources (e.g., LEDs, electroluminescence devices, and fluorescent substances) other than a laser scanner may be employed as light sources for exposure. In such cases, the "main scanning direction" may be parallel to a direction in which light emitting elements such as LEDs are aligned.

Furthermore, aspects of the present invention may be applied to image forming devices employing methods other than the aforementioned electrophotographic method (e.g., a toner-jet method using no photoconductive body, an ion flow method, and a multi-stylus electrode method).

Referring to FIG. 4, the voltages generated by the power supply circuits VA, VB, VC, and VD may have an arbitrary waveform (e.g., a sinusoidal waveform and a triangle waveform) other than the rectangle waveform as exemplified in the aforementioned embodiment. Further, in the aforementioned embodiment, the four power supply circuits VA, VB, VC, and VD are provided to generate the respective AC driving voltages with a phase difference of 90 degrees between any adjacent two of the power supply circuits VA, VB, VC, and VD in the aforementioned order. However, three power supply circuits may be provided to generate respective AC driving voltages with a phase difference of 120 degrees between any two of the three power supply circuits.

The photoconductive drum 3 and the development roller 62 may contact each other.

The configuration of the first electric-field transfer board 63 is not limited to that exemplified in the aforementioned embodiment. For instance, the first electric-field transfer board 63 may be configured without the overcoating layer 634.

The first electric-field transfer board 63 may be supported by a half-cylinder-shaped supporting member. Further, the first electric-field transfer board 63 may have a top portion formed in a flat shape. In this case, the first electric-field transfer board 63 may be formed in a trapezoidal shape when viewed in the main scanning direction (may be supported by a supporting member that is trapezoidal when viewed in the main scanning direction).

Further, the first electric-field transfer board 63 may be configured such that the toner transfer direction TTD is identical to the moving direction (the leftward direction in FIG. 2) of the toner holding surface 62*a* in the carrying area CA.

When the aforementioned "through-transfer" is performed during at least one of the periods of the times t2 to t3 (see FIGS. 5A to 5C) and the times t4 to t5 (see FIGS. 6A to 6C), the undesired situation as shown in FIGS. 7A and 7B can effectively be restrained.

FIGS. 8A to 8D are time charts for explaining operations of the laser printer 1 shown in FIG. 1. FIGS. 8A to 8C are the same as FIGS. 5A to 5C, respectively. FIG. 8D shows time variation of an output voltage from the retrieving-bias power supply circuit 653.

As illustrated in FIGS. 8A to 8D, when the image forming operation is started, initially (before the time t1: see FIGS. 8B and 8D), the second electric-field transfer board 64 may previously be driven by applying the retrieving bias while rotating the development roller 62. Namely, the "through-transfer" and the operation to make the toner holding surface 62*a* hold the toner T thereon may be carried out after the second electric-field transfer board 64 retrieves the toner T which remains on the toner holding surface 62*a* even after the previous image forming operation. Thereby, it is possible to effectively prevent the toner T, which remains on the toner holding surface 62*a* even after the previous image forming operation, from transferring onto the first electric-field transfer board 63.

What is claimed is:

1. A developer supply device configured to supply charged development agent to an image forming unit of an image forming apparatus, the image forming unit being configured to perform an image forming operation of forming an image thereon by the supplied development agent, the developer supply device comprising:

a developer holding body comprising a developer holding surface that is configured to hold the development agent thereon, formed as a cylindrical circumferential surface parallel to a first direction, and disposed to face the image forming unit in a first area where the development agent held on the developer holding surface is supplied to the image forming unit, wherein the developer holding body is configured to rotate around an axis parallel to the first direction such that the developer holding surface moves in a second direction perpendicular to the first direction;

a first transfer board comprising a plurality of first transfer electrodes arranged along a first developer transfer path perpendicular to the first direction, wherein the first transfer board is configured to, when a first bias including a multi-phase alternating-current voltage is applied to the first transfer electrodes, generate a first traveling-wave electric field along the first developer transfer path and transfer the development agent along the first developer transfer path with the first traveling-wave electric field, and wherein the first transfer board is disposed to face the developer holding surface in a second area between an upstream end and a downstream end in a developer transfer direction on the first developer transfer path;

a first bias applying unit configured to apply the first bias to the first transfer electrodes to transfer the development agent along the first developer transfer path;

a second bias applying unit configured to apply a second bias between the developer holding body and the first transfer board to transfer the development agent from the first transfer board onto the developer holding surface and make the developer holding surface hold the development agent; and a bias controller configured to, during the image forming operation performed by the image forming unit, control the first bias applying unit to apply the first bias to the first transfer electrodes and control the second bias applying unit to apply the second bias between the developer holding body and the first transfer board, so as to make the developer holding surface hold the development agent while transferring the development agent along the first developer transfer path, and wherein the bias controller is configured to, at least one of before and after the image forming operation, control the first bias applying unit to apply the first bias to the first transfer electrodes and control the second bias applying unit not to apply the second bias between the developer holding body and the first transfer board by changing a direct-current voltage component of the first bias applied to the first electrodes while applying a predetermined bias to the developer holding body, so as to transfer the development agent along the first developer transfer path without making the developer holding surface hold the development agent.

2. The developer supply device according to claim 1, further comprising:

a second transfer board comprising a plurality of second transfer electrodes arranged along a second developer transfer path perpendicular to the first direction, wherein the second transfer board is configured to, when a third bias including a multi-phase alternating-current voltage is applied to the second transfer electrodes, generate a second traveling-wave electric field along the second developer transfer path and transfer the development agent along the second developer transfer path with the second traveling-wave electric field, and wherein the second transfer board is disposed to face the developer holding surface in a third area that is located downstream relative to the first area in a moving direction of the developer holding surface; and a third bias applying unit configured to apply the third bias to the second transfer electrodes to retrieve the development agent by transferring the development agent from the developer holding surface to the second transfer board in the third area and convey the retrieved development agent to a developer storage section.

3. An image forming apparatus comprising:

a developer supply device configured to supply charged development agent; and an image forming unit configured to perform an image forming operation of forming an image thereon by the supplied development agent, wherein the developer supply device comprises:

a developer holding body comprising a developer holding surface that is configured to hold the development agent thereon, formed as a cylindrical circumferential surface parallel to a first direction, and disposed to face the image forming unit in a first area where the development agent held on the developer holding surface is supplied to the image forming unit, wherein the developer holding body is configured to rotate around an axis parallel to the first direction such that the developer holding surface moves in a second direction perpendicular to the first direction;

a first transfer board comprising a plurality of first transfer electrodes arranged along a first developer transfer path perpendicular to the first direction, wherein the first transfer board is configured to, when a first bias including a multi-phase alternating-current voltage is applied to the first transfer electrodes, generate a first traveling-wave electric field along the first developer transfer path and transfer the development agent along the first developer transfer path with the first traveling-wave electric field, and wherein the first transfer board is disposed to face the developer holding surface in a second area between an upstream end and a downstream end in a developer transfer direction on the first developer transfer path;

a first bias applying unit configured to apply the first bias to the first transfer electrodes to transfer the development agent along the first developer transfer path;

a second bias applying unit configured to apply a second bias to between between the developer holding body and the first transfer board to transfer the development agent from the first transfer board onto the developer holding surface and make the developer holding surface hold the development agent; and a bias controller configured to, during the image forming operation performed by the image forming unit, control the first bias applying unit to apply the first bias to the first transfer electrodes and control the second bias applying unit to apply the second bias between the developer holding body and the first transfer board, so as to make the developer holding surface hold the development agent while transferring the development agent along the first developer transfer path, and wherein the bias controller is configured to, at least one of before and after the image forming operation, control the first bias applying unit to apply the first bias to the first transfer electrodes and control the second bias applying unit not to apply the second bias between the developer holding body and the first transfer board by changing a direct-current voltage component of the first bias applied to the first electrodes while applying a predetermined bias to the developer holding body, so as to transfer the development agent along the first developer transfer path without making the developer holding surface hold the development agent.

4. The image forming apparatus according to claim 3, wherein the developer supply device further comprises:

a second transfer board comprising a plurality of second transfer electrodes arranged along a second developer transfer path perpendicular to the first direction, wherein the second transfer board is configured to, when a third bias including a multi-phase alternating-current voltage is applied to the second transfer electrodes, generate a second traveling-wave electric field along the second developer transfer path and transfer the development agent along the second developer transfer path with the second traveling-wave electric field, and wherein the second transfer board is disposed to face the developer holding surface in a third area that is located downstream relative to the first area in a moving direction of the developer holding surface; and a third bias applying unit configured to apply the third bias to the second transfer electrodes to retrieve the development agent by transferring the development agent from the developer holding surface to the second transfer board in the third area and convey the retrieved development agent to a developer storage section.

* * * * *

UNITED STATES PATENT AND TRADEMARK OFFICE

CERTIFICATE OF CORRECTION

PATENT NO. : 8,498,557 B2
APPLICATION NO. : 13/015649
DATED : July 30, 2013
INVENTOR(S) : Kenjiro Nishiwaki It is certified that error appears in the above-identified patent and that said Letters Patent is hereby corrected as shown below:

In the Claims

In Claim 3, Column 16, Line 5:
Please delete "to between".

Signed and Sealed this
Twelfth Day of August, 2014

Michelle K. Lee

Michelle K. Lee
*Deputy Director of the United States Patent and Trademark Office*